US005297800A

United States Patent [19]

Delaney

[11] Patent Number: 5,297,800

[45] Date of Patent: Mar. 29, 1994

[54] ULTRA-ENIGMA CODE GAME

[76] Inventor: Gordon J. Delaney, 2002 Maple Ave., Downers Grove, Ill. 60515

[21] Appl. No.: 62,598

[22] Filed: May 18, 1993

[51] Int. Cl.[5] ..... A63F 9/00

[52] U.S. Cl. ..... 273/429; 273/238; 273/460; 380/59

[58] Field of Search ..... 273/433, 429, 430, 431, 273/432, 460, 237, 238, 273; 380/9, 59

[56] References Cited

U.S. PATENT DOCUMENTS

| | | | |
|---|---|---|---|
| 2,844,374 | 7/1958 | French | 273/273 X |
| 3,149,841 | 9/1964 | Hullman | 273/433 |
| 3,404,889 | 10/1968 | Warner, III | 273/238 X |
| 3,887,189 | 6/1975 | Dawes | 273/238 |
| 3,942,800 | 3/1976 | Holbrook | 380/1 X |
| 4,339,135 | 7/1982 | Breslow et al. | 273/433 X |
| 4,502,048 | 2/1985 | Rehm | 380/52 X |
| 4,509,758 | 4/1985 | Cole | 380/59 |
| 4,541,633 | 9/1985 | Newbill | 273/238 |
| 4,560,164 | 12/1985 | Darling | 380/58 X |
| 4,957,298 | 9/1990 | Silverman | 380/59 X |

*Primary Examiner*—William H. Grieb
*Attorney, Agent, or Firm*—Charles F. Meroni, Jr.

[57] ABSTRACT

The cryptography game is an electrical device having a sending panel and opposite receiving panel, with a privacy extending upwardly between them. A probe is provided which engages within jacks on the sending panel which are identified with letters of the alphabet. The jacks engage one end of a cable via a connector assembly to the other end of which a plurality of LED's on the receiving panel are connected via a further connecter assembly. Power is provided from a battery having a resistor in the line to control current. When the probe is engaged within the jack completing the circuit a cooperating LED lights, indicating a specific letter of the alphabet. The "code" is determined by positioning of the cable connectors, which each have 26 slots, over an equal number of pins of two forty pin connectors, the position of the cable connectors creating multiple encryption possibilities by their specific positioning.

20 Claims, 5 Drawing Sheets

FIGURE 1
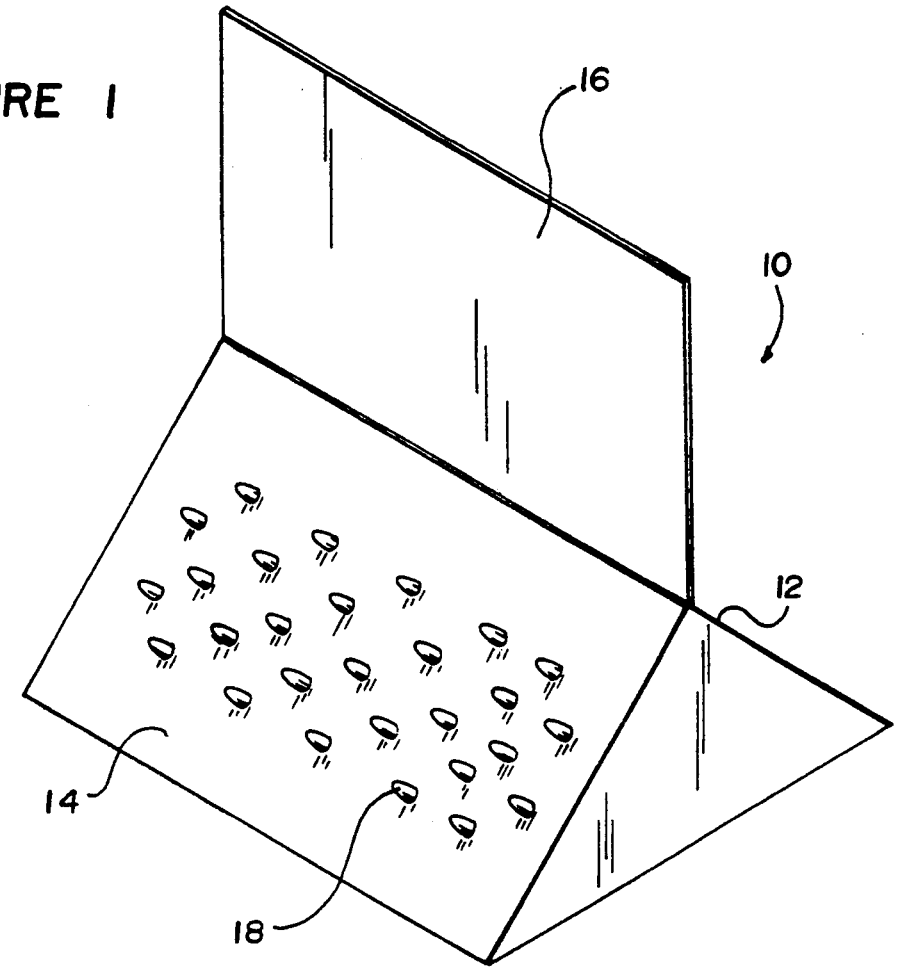
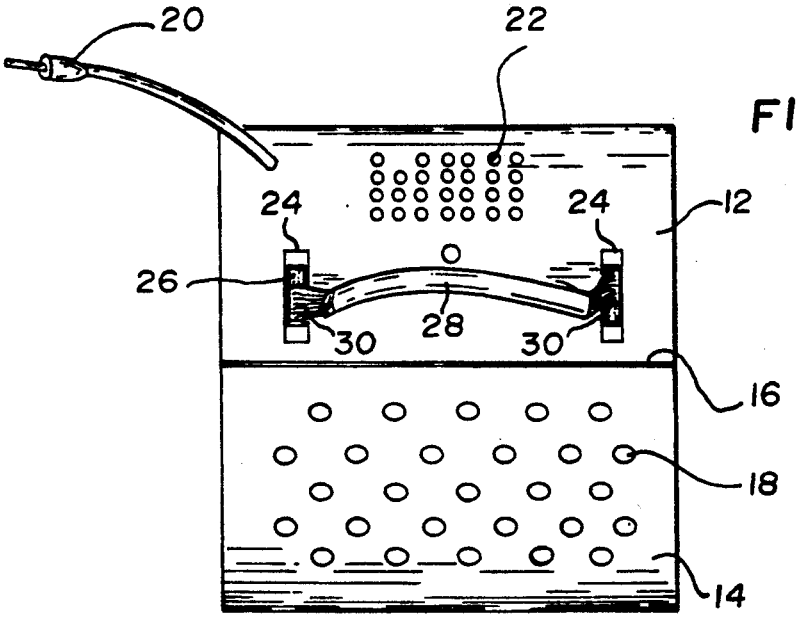
FIGURE 2

FIGURE 3
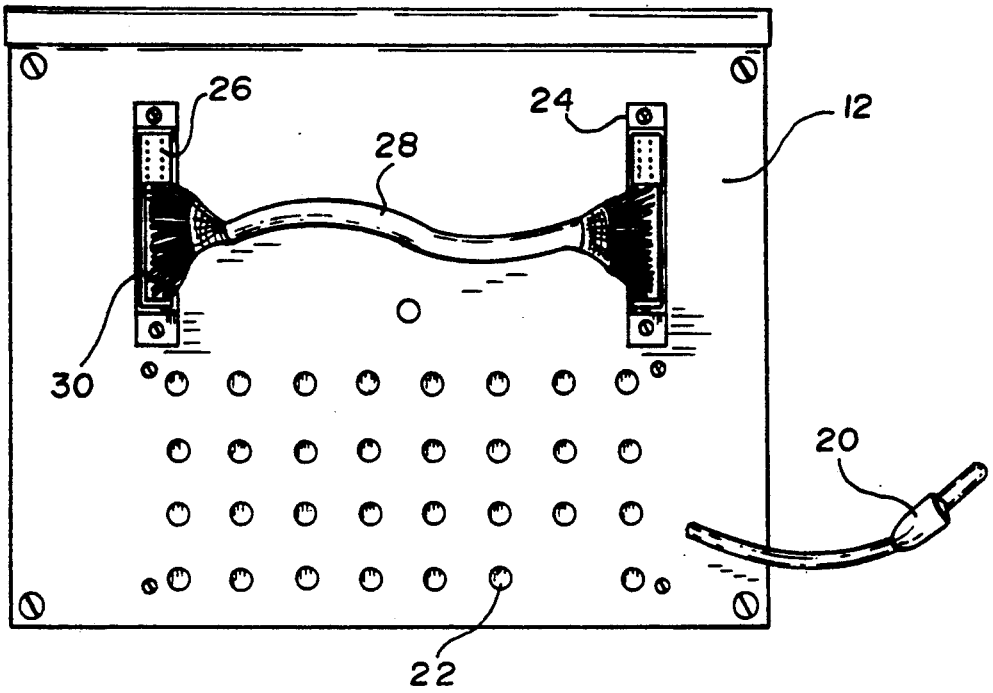
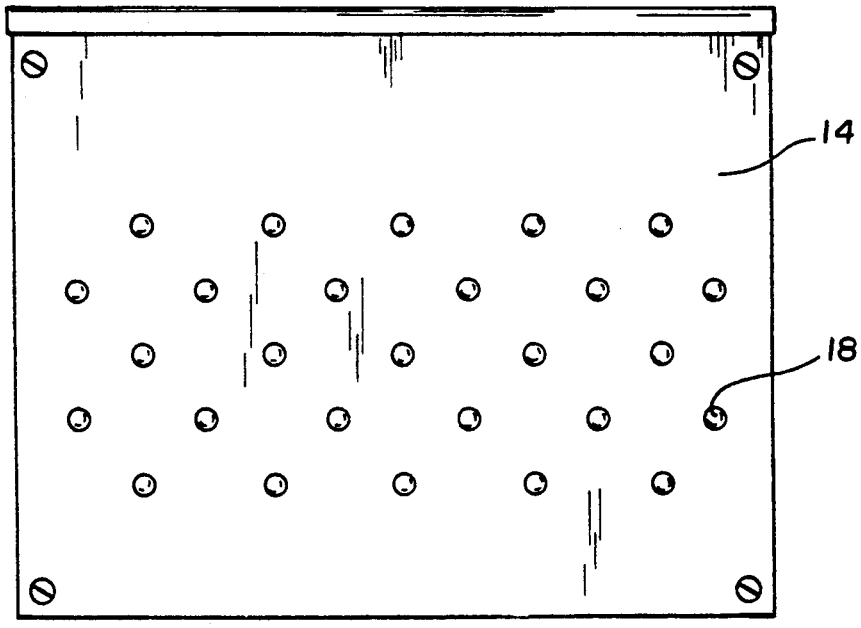
FIGURE 4

ULTRA-ENIGMA CODE GAME

BACKGROUND OF THE INVENTION

1. Field of the Invention

The present invention relates to a cryptography game. More particularly, the game comprises an electronic apparatus having a transmitting face and a receiving face, a coded message being sent therebetween for deciphering. The game allows for various code combinations to be utilized once a particular code combination has been deciphered.

2. Description of the Prior Art

Heretofore various cryptographic game apparatus have been proposed for use by cryptology buffs in attempting to decipher codes.

Examples of such apparatus may be found in U.S. Pat. Nos. 3,942,800; 4,957,298; 4,502,048; 4,509,758 and 4,560,164.

All of these games are non-electrical. As will be described in greater detail hereinafter, the game disclosed herein is completely electrical and allows for 256 different combinations of codes.

SUMMARY OF THE INVENTION

According to the invention there is provided an electronic cryptography game which offers a variety of code possibilities, the game comprising, a sending or transmitting panel having a plurality of electrical jacks, each jack identifying a letter of the alphabet and a space, an electronic probe on the sending panel configured for engagement within one jack at a time, a receiving panel having a plurality of light emitting members thereon, each light emitting member identifying a letter of the alphabet and a space, the light emitting members and the jacks being interconnected via a cable having a multiple slotted connector at each end thereof, one of the multiple slotted connectors seating over a first board mounted multiple pin connector engaged to the jacks and the other multiple slotted connector seating over a second board mounted multiple pin connector engaged to the light emitting members, a power supply having a resistance in a line thereof, the line feeding the light emitting members and the probe in a manner where a complete circuit is formed between one jack and one light emitting member when the probe is brought into contact with the jack.

BRIEF DESCRIPTION OF THE DRAWINGS

FIG. 1 is a perspective view of the game as seen from the receiving players side.

FIG. 2 is a top plan view of the game of FIG. 1.

FIG. 3 is a plan view of the transmitting face or panel of the game.

FIG. 4 is a plan view of the receiving face panel of the game.

DESCRIPTION OF THE PREFERRED EMBODIMENT

Figure 5A:
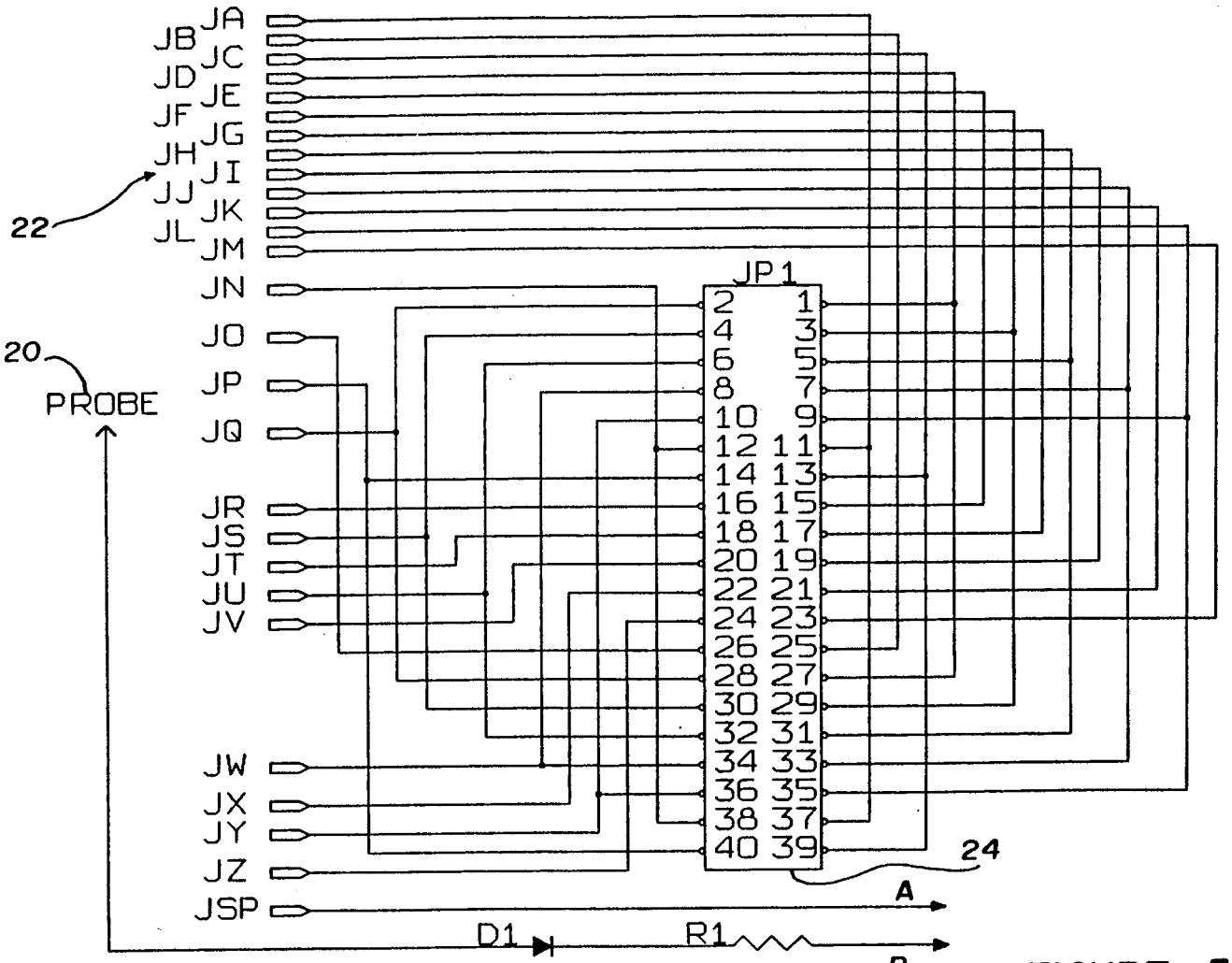
FIGS. 5A and 5B create a circuit diagram of one possible configuration using two board mounted forty pin connectors.

Referring now to the drawings in greater detail there is illustrated therein the cryptography game of the present invention generally identified by the reference numeral 10.

The game comprises a triangular in cross section base member having a sloped transmitting face 12 and a sloped receiving face 14 Situated to shield each face from the other is an upstanding privacy panel 16.

On the receiving face 14 are positioned a plurality of, i.e., 27, LED's 18 which are labelled "A" to "Z" and "space".

On the transmitting face 12 there are provided a probe 20 which is seatable within chosen ones of a plurality of electrical jacks 22 which are also labelled as defined above.

Also provided are two electrical multipin connectors 24. These multipin connectors 24 may have as many as 40 male pins 26 thereon. Also provided and engaged between the connectors 24 is a cable 28 which has at each end thereof a female multiconnector 30 which is engageable to a specific chosen plurality of male pins 26 on the connectors 24.

In this respect, the cable connectors 30 each have 26 slots therein, which engage over 26 of the plurality of pins 26 on the board mounted connectors 24.

The cable connectors 30 can be seated over the pins 26 in any manner desired, and can be rotated 180° to create a further number of possible engagement patterns. Thus, for example, when a forty pin connector 24 is used, sixteen possible positions are created, offering two hundred fifty six possible code combinations.

Obviously, a greater number of combinations may be created by increasing the plurality of pins 26.

Each connector pin 26 of one of the connectors 24 is wired to a particular one of the electrical jacks 22, though the order may be set as desired.

Figure 5B:
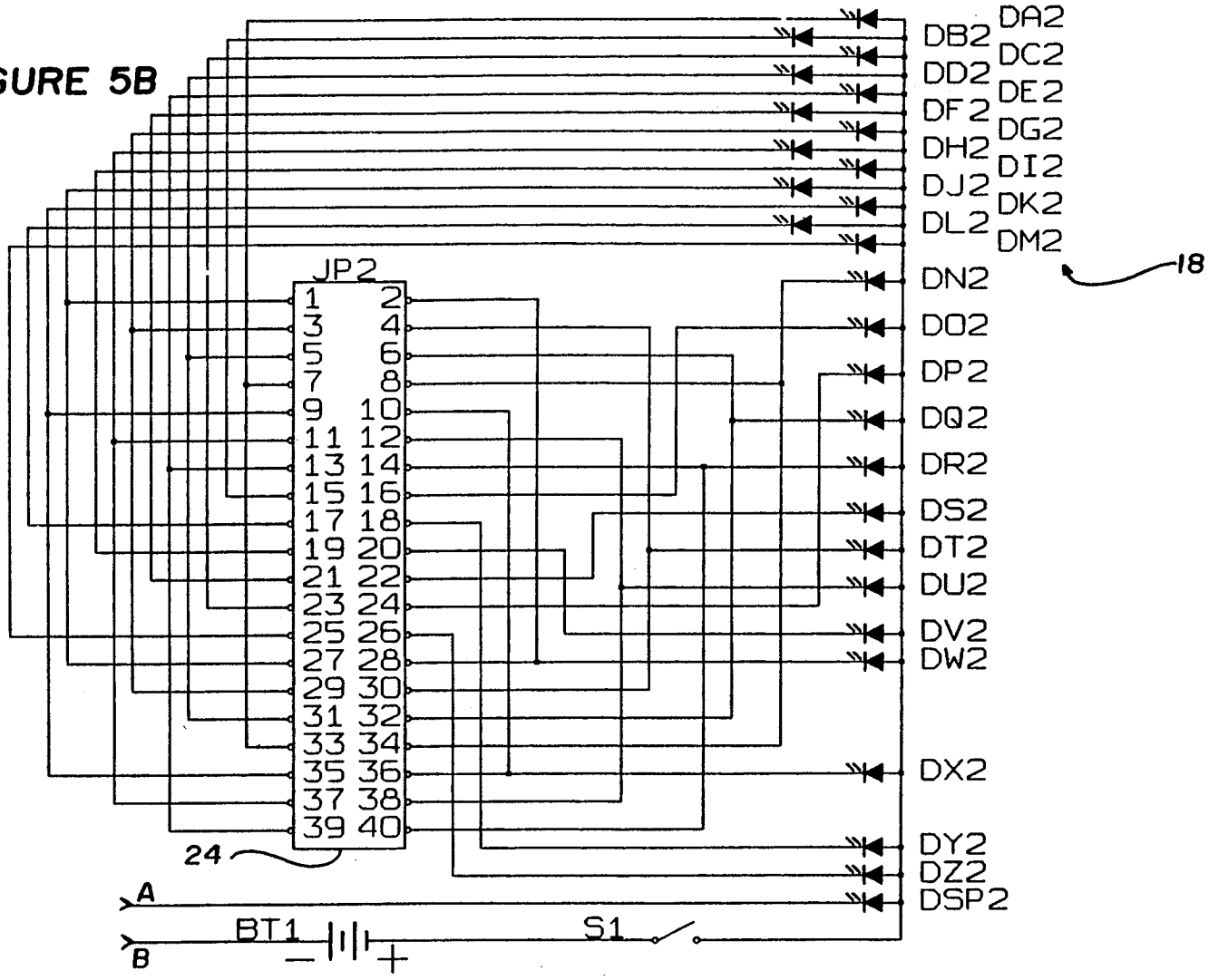

Further, each LED diode 18 is wired to a particular connector pin 26 of the other connector 24, with the left over pins 26 being shorted as shown in FIG. 5. The need for the shorting is that only 26 LED's are provided, so only a 26 pin connection is desired, so that potential signals to be sent do not go astray.

It will be understood here that the "space indicating jack 22 and LED 18 are hard wired to each other to allow for a 26 slot multiconnector 30 to be used.

Figure 6:
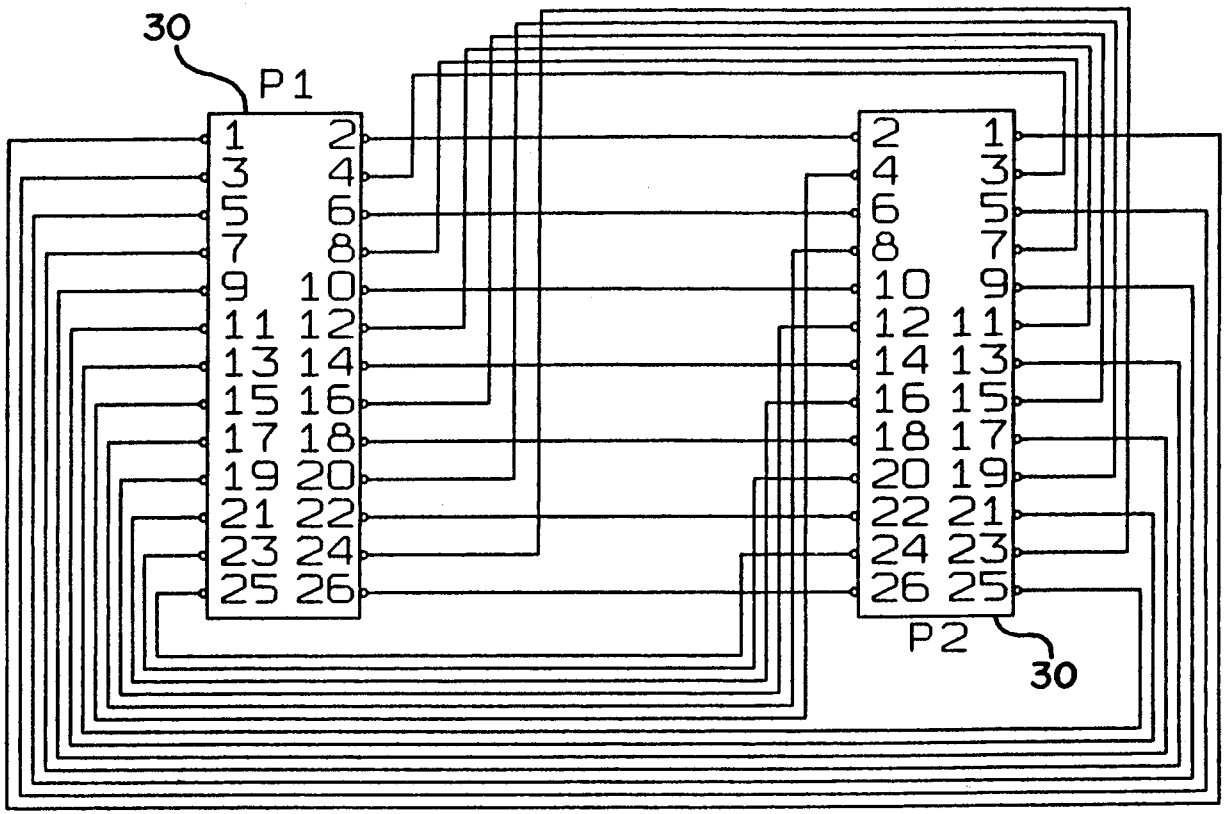
FIG. 6 is a circuit diagram of one possible configuration using two board mounted twenty six pin connectors.

Turning now to a study of the diagrams of FIGS. 5 and 6 and reiterating from above, the transmitting panel 12 includes a plurality of jacks 22 labeled, for reference, alphabetically A through Z inclusively and SP for space, LED's 18 labeled alphabetically A through Z inclusively and space, two multipin connectors 24, two cable connectors 26, a resistor R1, a 9 Volt battery BT and single pole on/off power switch S1. Each jack 22 and LED 18 has its corresponding letter of the alphabet printed on or near it for player reference during the play of the game.

One contact of each of the jacks 22 is connected to one end of the current limiting resistor R1. The other end of resistor R1 is connected to a negative terminal of Battery BT1.

Each of the remaining contacts of each of the aforementioned jacks 22 A through Z and SP is connected to the cathode of a related LED: A's remaining contact being connected to LED A's cathode, B's remaining contact being connected to LED B's cathode and so on alphabetically, for example.

Additionally, each of the remaining Contacts of each of the aforementioned jacks A through Z is connected to one pin of one board mounted connector 24.

The anodes of LEDs A through Z inclusively and LED SP are all connected together and, in turn, are connected to one terminal of power Switch S1.

For simplicity, FIG. 5 shows a basic connection pattern which is not likely to be used in playing the game but will serve as a means of explaining how the game works. In the embodiment shown slots 28 of one cable connector 30 are connected to like slots 28 of the other cable connector 30.

With power switch S1 turned on and using the cable 28, 26 complete circuits are made possible. When a sending player engages the probe 20 in a jack 22 labeled with a particular letter, A for instance, its contacts will be connected together completing a circuit which will cause current to flow from the negative terminal of battery BT1 through resistor R1 through the cable 28 and connectors 30 to the cathode of LED. With a value for resistor R1 chosen to allow the LED to glow brightly enough to be seen, LED A will glow. LED A indicates the letter transmitted to the receiving player.

By engaging probe 20 to a jack 22 corresponding to a letter on the transmitting panel 12 corresponding LED, as determined by the position of the encryption cable 28 used, will light on the receiving panel 14. For the example using the encryption cable position of FIG. 5, a direct correspondence of jacks A through Z inclusive, to LED's A through Z inclusive exists.

In this manner the sending player can transmit a message to the receiving player on by engaging the probe 20 within the jacks 22 corresponding to the letters of the message one at a time, using the "Space" jack, which always causes LEDs SP to light, as a means of indicating a space between words, or a period as will be defined further on.

Obviously, many combinations of encryption are possible, adding to the challenge of the game.

To those skilled in the art, many different means of embodiment are possible within the art of this invention such as, but not limited to: providing power from an alternate source such as a power supply plugged into AC power and modifying resistor R1 to adjust the current in the LEDs or substituting incandescent lamps for LEDs with an appropriate adjustment of resistor R1.

Game Play

Two or more teams or players needed for play, one being the sender and the other being the receiver.

Before sending the coded message the cable connectors 30 are arbitrarily seated over the pins 26.

The sender spells out a three part message by making a contact between the probe 20 and jacks 22 on the transmitting panel 12. Space is touched once to designate the end of a word, and three times to designate a period.

The receiving team or player is on the receive side of the console and receives and records the coded message.

If competing receivers are present, they race against each other to be the first to correctly solve the complete coded message.

If a team believes it has correctly deciphered the sentences received, they show it to the sender who will verify correctness. If the team is correct, it receives five points. If they are incorrect, the decoding continues until a team provides a correct solution.

Proposed scoring is as follows:

5 points for being right the first time.

3 points for 1 wrong guess and correctly solving the message.

1 point for 2 wrong guesses and correctly solving the message.

0 points for 3 wrong guesses and then correctly solving the message.

0 points for second place.

After 3 games are played the team with the most points wins.

As described above, the game 10 has a number of advantages, some of which have been described above and others which are inherent in the invention. Also modifications can be proposed to the game 10 without departing from the teachings herein.

For example, although jacks 22 and a coacting probe 20 are disclosed for use on the transmitting sending panel 12 there is nothing to preclude use of other structures, such as push buttons.

Accordingly, the scope of the invention is only to be limited as necessitated by the accompanying claims.

While the preferred form of the invention has been specifically illustrated and described herein, it will be apparent to those skilled in the art that modifications and improvements may be made to the form herein specifically disclosed. Accordingly, the present invention is not to be limited to the form herein specifically disclosed or in any other way inconsistent with the progress in the art promoted by this invention.

I claim:

1. An electronic cryptography game which offers a variety of code possibilities, the game comprising;

a transmitting panel having a plurality of electrical jacks, each jack identifying a letter of the alphabet and a space;

an electronic probe on the sending panel configured for engagement within one jack at a time;

a receiving panel having a plurality of light emitting diodes thereon, each light emitting diode identifying a letter of the alphabet and a space;

said light emitting diodes and said jacks being interconnected via a cable having a multiple slotted connector at each end thereof, one of the multiple slotted connectors seating over a first board mounted multiple pin connector engaged to said jacks and the other multiple pin slotted connector seating over a second board mounted multiple pin connector engaged to said light emitting diodes;

a power supply having a resistance in a line thereof, said line feeding said light emitting diodes and said probe in a manner where a complete circuit is formed between one jack and one diode when said probe is brought into contact with said one jack.

2. The game of claim 1 wherein said cable connectors each have twenty six slots.

3. The game of claim 2, wherein said board mounted connectors each have at least 26 pins.

4. The game of claim 3 wherein said connectors each have 40 pins.

5. The game of claim 4 wherein various jack and diode combinations can be created by varied positioning of the cable connectors relative to the pins of the board mounted connectors.

6. The game of claim 1 wherein said power source is a battery.

7. The game of claim 1 wherein said power source is an AC current.

8. The game of claim 5 wherein more than 200 diode and jack combinations are provided.

9. The game of claim 8 wherein more than 500 diode and jack combinations are provided.

10. An electronic cryptography game which offers a variety of code possibilities, the game comprising;

a transmitting panel having a plurality of electrical jacks, each jack identifying a letter of the alphabet and a space;

an electronic probe on the sending panel configured for engagement within one jack at a time;

a receiving panel having a plurality of light emitting members thereon, each light emitting member identifying a letter of the alphabet and a space;

said light emitting members and said jacks being interconnected via a cable having a multiple slotted connector at each end thereof, one of the multiple slotted connectors seating over a first board mounted multiple pin connector engaged to said jacks and the other multiple pin slotted connector seating over a second board mounted multiple pin connector engaged to said light emitting members;

a power supply having a resistance in a line thereof, said line feeding said light emitting members and said probe in a manner where a complete circuit is formed between one jack and one light emitting member when said probe is brought into contact with said jack.

11. The game of claim 10 wherein said cable connectors each have twenty six slots.

12. The game of claim 11, wherein said board mounted connectors each have at least 26 pins.

13. The game of claim 12 wherein said connectors each have 40 pins.

14. The game of claim 10 wherein said power source is a battery.

15. The game of claim 10 wherein said power source is an AC current.

16. The game of claim 11 wherein more than 200 diode and jack combinations are provided.

17. The game of claim 13 wherein more than 500 diode and jack combinations are provided.

18. The game of claim 17 wherein said light emitting member is a diode.

19. The game of claim 17 wherein said light emitting member is a bulb.

20. An electronic cryptography game which offers a variety of code possibilities, the game comprising;

a transmitting panel having a plurality of electrical jacks, each jack identifying a letter of the alphabet and a space;

an electronic probe on the sending panel configured for engagement within one jack at a time;

a receiving panel having a plurality of light emitting members thereon, each light emitting member identifying a letter of the alphabet and a space;

a cable having a multiple slotted connector at each end therof interconnecting said light emitting members and said jacks, one of the multiple slotted connectors seating over a first board mounted multiple pin connector engaged to said jacks and the other multiple pin slotted connector seating over a second board mounted multiple pin connector engaged to said light emitting members; and a power supply having a resistance in a line thereof, said line feeding said light emitting members and said probe in a manner where a complete circuit is formed between one jack and one light emitting member when said probe is brought into contact with said jack, means on said multiple slotted connectors enabling ready disconnection and reconnection creating various jack and light emitting member combinations creatable by varied positioning of the cable connectors relative to the pins of the board mounted connectors.

* * * * *